United States Patent [19]

Saito et al.

[11] Patent Number: 4,616,152

[45] Date of Patent: Oct. 7, 1986

[54] PIEZOELECTRIC ULTRASONIC PROBE USING AN EPOXY RESIN AND IRON CARBONYL ACOUSTIC MATCHING LAYER

[75] Inventors: Koetsu Saito, Sagamihara; Keisaku Yamaguchi, Isehara; Masami Kawabuchi, Yokohama, all of Japan

[73] Assignee: Matsushita Electric Industrial Co., Ltd., Osaka, Japan

[21] Appl. No.: 668,214

[22] Filed: Nov. 5, 1984

[30] Foreign Application Priority Data

Nov. 9, 1983 [JP] Japan ..... 58-210103

[51] Int. Cl.[4] ..... H01L 41/08

[52] U.S. Cl. ..... 310/334; 73/644; 310/327; 310/335; 367/152

[58] Field of Search ..... 310/334–336, 310/327; 73/632, 642, 644; 367/150, 152, 157

[56] References Cited

U.S. PATENT DOCUMENTS

| | | | |
|---|---|---|---|
| 3,362,501 | 1/1968 | Lenahan | 310/334 X |
| 3,663,842 | 5/1972 | Miller | 73/644 X |
| 4,184,094 | 1/1980 | Kopel | 367/152 X |
| 4,297,607 | 10/1981 | Lynnworth et al. | 310/334 |

FOREIGN PATENT DOCUMENTS

| | | | |
|---|---|---|---|
| 0198998 | 11/1983 | Japan | 310/334 |

*Primary Examiner*—Mark O. Budd

*Attorney, Agent, or Firm*—Stevens, Davis, Miller & Mosher

[57] ABSTRACT

An ultrasonic probe for an ultrasonic medical diagnostic apparatus which is composed of a piezoelectric vibrator with electrodes attached onto both surfaces thereof and one or two acoustic matching layers which are provided on the surface of one electrode of the piezoelectric vibrator. One of the acoustic matching layers is made of thermosetting resin such as epoxy resin mixed with magnetic material. A backing load member which is made of ferrite rubber or plastic mixed with tungsten powder is provided on the surface of the other electrode of the piezoelectric vibrator. An acoustic lens which is made of silicone rubber may be disposed on the upper acoustic matching layer. The acoustic matching layers may be formed by pouring the materials, thereby to form the ultrasonic probe without an intermedium of a different kind of material on the piezoelectric vibrator.

8 Claims, 2 Drawing Figures

PIEZOELECTRIC ULTRASONIC PROBE USING AN EPOXY RESIN AND IRON CARBONYL ACOUSTIC MATCHING LAYER

BACKGROUND OF THE INVENTION

This invention relates to an ultrasonic probe which is used for an ultrasonic medical diagnostic apparatus and which serves as a transmitter and receiver of a sound wave.

There are various types of ultrasonic diagnostic apparatus, and hence, various types of ultrasonic probes for various purposes.

As representative ultrasonic probes, there are a single-type ultrasonic probe which essentially consists of a sheet of circular piezoelectric vibrator and an array-type ultrasonic probe in which multiple strips of micro piezoelectric vibrators are arrayed on a straight line. Since the structures of these probes are basically the same, the array-type ultrasonic probe will be explained as an example in the following.

The array-type ultrasonic probe is composed of multiplicity of strips of piezoelectric vibrators with electrodes attached onto both surfaces. Piezoelectric ceramic or the like is used for the piezoelectric vibrator and those piezoelectric vibrators with electrodes are set in array. On the electrode of the piezoelectric vibrator on the side of an object to be examined an acoustic matching layer is formed and, if necessary, an acoustic lens is disposed thereon. On the other hand, on the surface of the piezoelectric vibrator contrary to the object to be examined a backing load member is provided.

The acoustic matching layer consists of one or two layers made of glass, plastic material which is mixed with tungsten powder, or epoxy resin. When the acoustic matching layer made of these materials is attached to the piezoelectric vibrator, an adhesive should be made even and thin, and when the ultrasonic probe is operated with high-frequency waves, the matching layer should be made very thin to a degree of the order of several tens of microns, which makes the manufacture of the ultrasonic probe very difficult.

SUMMARY OF THE INVENTION

Accordingly it is an object of the invention to solve the problems in the prior art described above and to provide an ultrasonic probe which has uniform high efficiency and high resolution property and in which a material that is mechanically strong and can be laid directly on a piezoelectric vibrator without an intermedium of a different kind of material, is used for a first matching layer of the two acoustic matching layers.

To this end this invention provides an ultrasonic probe comprising: a piezoelectric vibrator with electrodes attached onto both surfaces thereof; a first acoustic matching layer which is provided on one electrode surface of the piezoelectric vibrator and which is made of thermosetting resin mixed with magnetic material; and a second acoustic matching layer which is provided on the first acoustic matching layer.

BRIEF DESCRIPTION OF THE DRAWINGS

This and other objects as well as advantages of the present invention will become clear by the following description of a preferred embodiment of the present invention with reference to the accompanying drawings, wherein.

In these drawings like reference numerals denote like elements.

DETAILED DESCRIPTION OF THE INVENTION

Figure 1:
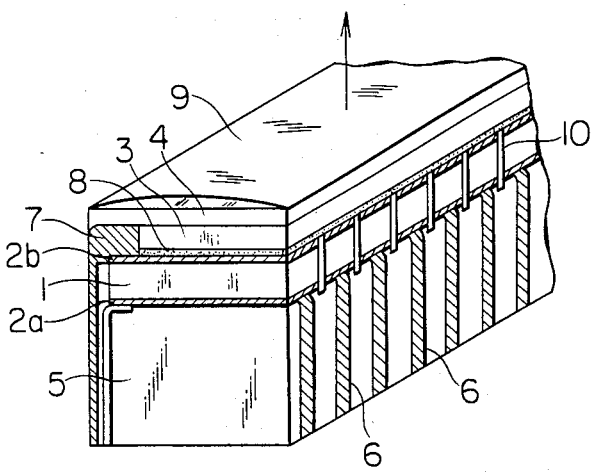
FIG. 1 is a perspective view of a conventional array type ultrasonic probe.

Before description of the invention a conventional ultrasonic probe will be explained with reference to the drawing for a better understanding of the invention.

FIG. 1 shows an example of a structure of an array type ultrasonic probe. On the opposite side to an object to be examined of a piezoelectric vibrator 1 which is made of piezoelectric ceramic or the like, a backing load member 5 for expanding the frequency width of ultrasonic waves and obtaining the mechanical strength of the ultrasonic probe is provided through an electrode 2*a*. As the backing load member 5 ferrite rubber or a plastic material mixed with tungsten powder is used. On the other hand, on the side of the object to be examined of the piezoelectric vibrator 1, one or two acoustic matching layers 3, 4 for efficiently leading a sound wave to the object to be examined are provided on the electrode 2*b* and a bonding layer 8. Further, on these layers an acoustic lens 9 is provided. Numerals 6, 7 represent electrode terminals and 10 is a gap for dividing the piezoelectric vibrator 1. A material such as glass or plastic material mixed with tungsten powder is used as a material for the acoustic matching layer 3 on the side of the piezoelectric vibrator 1 and epoxy resin is used as a material for the acoustic matching layer 4 on the side of the object to be examined. The acoustic impedance of these materials is, generally, $8\sim15\times10^5$ g/cm$^2$·s in the acoustic matching layer 3 on the side of piezoelectric vibrator 1 (hereinunder "the first matching layer") and $2\sim4\times10^5$ g/cm$^2$·s in the acoustic matching layer 4 on the side of the object to be examined (hereinunder "the second acoustic matching layer"). The thickness of the first and the second acoustic matching layers 3, 4 is generally equal to a quarter wavelength of the sound wave which travels through each acoustic matching layer.

If glass is used as a material for the first matching layer 3, the acoustic impedance is $11\sim15\times10^5$ g/cm$^2$·s, which is an appropriate value from the viewpoint of acoustic impedance matching, but the probe is mechanically weak. Furthermore, in manufacturing, the first matching layer 3 must be bonded to the piezoelectric vibrator with an adhesive such as epoxy resin applied evenly in a thin thickness over 50–100 mm. The thickness of the bonding layer 8 has a great influence on the properties (efficiency, and resolution) of the ultrasonic probe; when the bonding layer is thick and uneven, it is difficult to obtain even and good properties of the ultrasonic probe. Therefore an ultrasonic probe in which glass is used for the first matching layer disadvantageously brings about a problem such as difficulty in manufacturing or decrease in the yield. On the other hand, when a plastic material mixed with tungsten powder is used for the first matching layer 3, the acoustic impedance can be freely selected ($8\sim15\times10^5$ g/cm$^2$·s), and the probe is mechanically strong. However, this case has drawbacks similar to the above case of using glass. That is, since this material must be pressurized at a temperature not lower than 100° C. in manufacturing, it is necessary to bond this material with the piezoelectric vibrator 1 after the material is produced. In addition, since the velocity of sound of this material is as slow as 1600 m/sec, the matching layer should be made very thin when the ultrasonic probe is operated with high-frequency waves, for example, 80 micron when the frequency is 5 MHz, which makes the manufacture of the ultrasonic probe very difficult.

Figure 2:
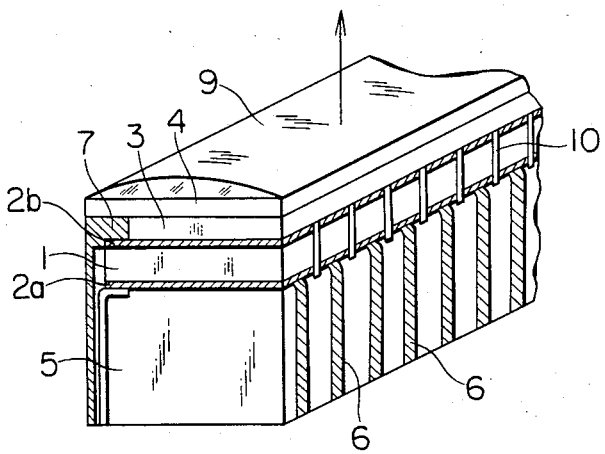
FIG. 2 is a perspective view of an embodiment of an ultrasonic probe according to the invention.

FIG. 2 is a perspective view of an embodiment of an ultrasonic probe according to the invention.

The electrode terminals 6 are bonded to the electrode 2*a* of the piezoelectric vibrator 1 by soldering or the like, and the backing load member 5 composed of ferrite rubber or a plastic material mixed with tungsten powder is bonded onto the surface of the electrode terminals 6. Subsequently, the piezoelectric vibrator 1 is divided into a plurality of portions by machining or laser-machining the gaps 10 thus formed are filled with a material the acoustic impedance of which is small, and the attenuation of sound wave of which is large, such as for example, silicon rubber mixed with plastic microbaloon. Then, a material for the first matching layer 3 is poured onto the common electrode 2*b* to form into the thickness of a quarter wavelength. This material for the first matching layer 3 is epoxy resin mixed with powder of magnetic material. For instance, in the case of wave absorbing material produced by Emerson and Cumming Company (ECCOSORBCR-124) which is an epoxy resin having iron carbonyl mixed therein the acoustic impedance is $11\times10^5$ g/cm$^2$·s, the velocity of sound is 2500 m/sec and it cures in 12 hours at 60° C.

Subsequently an electrode terminal 7 is bonded to the common electrode 2*b* by soldering or the like, and the second matching layer 4 of a thickness of a quarter wavelength is formed by the same pouring method as in the first matching layer 3. On the second matching layer 4 an acoustic lens 9 such as silicone rubber is provided.

As described above, this invention, which introduces epoxy resin composed with magnetic material, the acoustic impedance of which is $11\times10^5$ g/cm$^2$·s, and which can be poured and set at a temperature not higher than 100° C., as a material for the first matching layer 3, makes it possible to easily obtain an ultrasonic probe of high efficiency and uniform properties. In other words, this invention has no bonding layer 8 shown in FIG. 1 between the piezoelectric vibrator 1 and the first matching layer 3 unlike the conventional ultrasonic probe, which removes nonuniformity and deterioration of properties caused by the bonding layer 8. In addition, the acoustic impedance is $11\times10^5$ g/cm$^2$·s, which satisfies the acoustic matching condition and increases efficiency. Furthermore, the high velocity of sound of 2500 m/sec allows the ultrasonic probe with a frequency of as high as 5 MHz to be made as thick as 125 micron, which is thick enough to be formed easily. Still further, unlike the case of using glass in the prior art which has a defect in mechanical strength, this invention heightens reliability in mechanism.

The material for the first matching layer 3 of the embodiment may be divided into a plurality of portions together with the piezoelectric vibrator 1 after it is formed on the piezoelectric vibrator 1. Further, it is possible to make the ultrasonic probe by forming the material for the second matching layer 4 into a sheet in advance and bonding it to the piezoelectric vibrator 1 with the material for the first matching layer 3, as an adhesive, which is poured onto the piezoelectric vibrator 1. In this embodiment the gaps 10 are filled with silicone rubber mixed with plastic microbaloon, but it may be substituted by the material for the first matching layer.

It is clear that though this embodiment is applied to the array-type ultrasonic probe in which piezoelectric vibrators are arrayed on a straight line, this invention is also applicable to various kinds of ultrasonic probes such as a single-type ultrasonic probe with a sheet of piezoelectric vibrator, an arc-type ultrasonic probe, etc.

As is obvious from the above description, according to this invention, which introduces a new material for the first matching layer in place of the conventional material such as glass or epoxy resin mixed with tungsten powder, and which enables an ultrasonic probe to be formed by pouring the new material for the first matching layer without an intermedium of a different kind of material on the piezoelectric vibrator, an ultrasonic probe can be realized which has high efficiency, high resolution, and high mechanical reliability.

While there has been described what is at present considered to be a preferred embodiment of the invention, it will be understood that various modifications may be made therein, and it is intended that the appended claims cover all such modifications as fall within the true spirit and scope of the invention.

What is claimed is:

1. An untrasonic probe comprising: a piezoelectric vibrator with electrodes attached onto both surfaces thereof; a first acoustic matching layer which is provided on the surface of one electrode of said piezoelectric vibrator; and a second acoustic matching layer which is provided on said first acoustic matching layer; said first acoustic matching layer comprising a thermosetting resin mixed with iron carbonyl material.

2. An ultrasonic probe according to claim 1, wherein said thermosetting resin is epoxy resin.

3. An ultrasonic probe according to claim 1, wherein said first acoustic matching layer is in a direct contact with the surface of said electrode of said piezoelectric vibrator.

4. An ultrasonic probe according to claim 1, wherein a backing load member is formed on the surface of the other electrode of said piezoelectric vibrator.

5. An ultrasonic probe according to claim 4, wherein said backing load member is composed of ferrite rubber or plastic mixed with tungsten powder.

6. An ultrasonic probe according to claim 1, wherein said first and second acoustic matching layers are formed by pouring said material.

7. An ultrasonic probe comprising a piezoelectric vibrator with electrodes attached onto both surfaces thereof; a first acoustic matching layer which is provided on the surface of one electrode of said piezoelectric vibrator and which comprises a thermosetting resin mixed with iron carbonyl material; a second acoustic matching layer which is provided on said first acoustic matching layer; an acoustic lens which is provided on said first acoustic matching layer, and backing load member which is provided on the surface of the outer electrode of said piezoelectric vibrator.

8. An ultrasonic probe comprising: a piezoelectric vibrator with electrodes attached onto both surfaces thereof; a first acoustic matching layer which is provided on the surface of one electrode of said piezoelectric vibrator and which comprises a thermosetting resin mixed with iron carbonyl material, and a second acoustic matching layer of thermosetting resin which is provided on said first acoustic matching layer; said first and second acoustic matching layers being formed by pouring each of said materials.

* * * * *